United States Patent [19]

Lang et al.

[11] 4,206,611

[45] Jun. 10, 1980

[54] METHOD AND APPARATUS FOR ELIMINATING EXTERNAL CONDENSATE ON A ROOM AIR CONDITIONER

[75] Inventors: Richard D. Lang, Chittenango; Richard E. Matthews, Syracuse, both of N.Y.

[73] Assignee: Carrier Corporation, Syracuse, N.Y.

[21] Appl. No.: 913,403

[22] Filed: Jun. 7, 1978

[51] Int. Cl.[2] ..... F25B 47/00

[52] U.S. Cl. ..... 62/85; 62/279

[58] Field of Search ..... 62/85, 285, 291, 279, 62/280, 288, 289

[56] References Cited

U.S. PATENT DOCUMENTS

| | | | |
|---|---|---|---|
| 2,375,851 | 5/1945 | Kalischer | 62/289 |
| 2,671,320 | 3/1954 | Patterson, Jr. | 62/279 |
| 3,079,769 | 3/1963 | Abbott | 62/279 |
| 3,373,578 | 3/1968 | Feeney et al. | 62/279 |
| 3,724,233 | 4/1973 | Pugh et al. | 62/280 |
| 3,996,764 | 12/1976 | Gilmer et al. | 62/279 |
| 4,023,380 | 5/1977 | Drouin | 62/279 |

FOREIGN PATENT DOCUMENTS

| | | | |
|---|---|---|---|
| 582227 | 11/1946 | United Kingdom | 62/279 |

*Primary Examiner*—Lloyd L. King

*Attorney, Agent, or Firm*—Donald F. Daley; Robert P. Hayter

[57] ABSTRACT

Apparatus for and a method of preventing the formation of moisture on the exterior of an air conditioning unit. Condensate collected at the evaporator and discharged into the condenser section of the unit absorbs heat energy eliminating cold spots on the exterior surface of the unit where moisture may condense. A condensate collection pan having various flow barriers is utilized to route the cold condensate from the evaporator along a tortuous path in heat exchange relationship with ambient air. Heat energy is transferred from the ambient air to the condensate in the condensate collection pan thereby acting to increase the temperature of the condensate prior to it being discharged into the condenser section.

9 Claims, 6 Drawing Figures

METHOD AND APPARATUS FOR ELIMINATING EXTERNAL CONDENSATE ON A ROOM AIR CONDITIONER

BACKGROUND OF THE INVENTION

1. Field of the Invention

This invention relates to moisture collection on the external surfaces of an air conditioning unit and more particularly to an apparatus and method for providing means to warm condensate formed on an evaporator as the condensate travels from the evaporator section to the condenser section of a room air conditioner.

2. Description of the Prior Art

In a typical room air conditioner a partition divides the unit into an evaporator section in communication with the environs to be cooled and a condenser section in communication with the outdoor ambient air. The unit typically has a vapor compression refrigeration circuit consisting of a compressor, condenser located in the condenser section, an expansion valve and an evaporator. The condensed liquid refrigerant is flashed from a liquid to gaseous state in the evaporator absorbing heat from the room air flowing over the evaporator and consequently cooling said air. During this process of flashing, heat is absorbed from the air and consequently its temperature is lowered thereby decreasing the amount of water that may be contained within the room air. The excess moisture that is no longer contained within the air is deposited on the evaporator surface as condensate. This condensate falls by gravity to the bottom of the unit and is conventionally collected in the condensate drain pan.

From the condensate drain pan the condensate at or near the relatively cold evaporator temperature is conducted through an opening in the partition to the condenser section. Once the condensate is within the condenser section it may be removed from the unit by simply draining it away, by use of a mechanical slinger or aspirator to place the condensate into the condenser fan airstream and consequently out of the unit through the condenser, said condensate acting to improve the efficiency of the condenser by evaporating and absorbing heat therefrom or the condensate may be retained within the condenser section of the unit until such time as it naturally evaporates.

Various methods of preventing moisture condensation or "sweating" on the exterior of the unit have been utilized. This sweating problem is caused by the cold condensate from the evaporator being conducted into the condenser section of the unit. Once within the condenser section this cold condensate which is at a much lower temperature than the ambient air causes localized portions of the condenser section to be lowered in temperature. Once these portions are lowered in temperature below the dew point of the ambient air in contact with that portion of the condenser section moisture is formed on the exterior of the unit. This moisture is unwanted and may cause dripping or other moisture problems which result when water that is difficult to funnel or drain away is collected. Often in an exterior mounted window unit this water simply drips and depending on the location may fall on a sidewalk or other pedestrian area.

The methods used to eliminate this sweating problem have included insulating the base pan in the condenser section of the unit such that there is thermal insulation between the cold condensate and the exterior surface of the unit. This does prevent sweating from occurring. Another method as disclosed in U.S. Pat. No. 4,107,939 entitled "Apparatus For Reducing External Condensate In An Air Conditioning Unit" discloses the use of air pressure differentials within the condenser section of the unit to cause the collected condensate to circulate. Hence, the condensate that has been warmed in the condenser section is mixed with the cold condensate and consequently the average temperature is such that no sweating occurs. The herein described method and apparatus provides for the cold condensate to be warmed prior to its entering the condenser section of the unit. Various flow barriers are utilized such that the condensate follows a tortuous path absorbing heat from the material in which it is in contact and from the ambient air circulated between the evaporator scroll and the partition for the purpose of transferring heat to the condensate.

SUMMARY OF THE INVENTION

An object of the present invention is to provide a condensate drain pan for collecting and transporting the condensate from the evaporator of an air conditioning unit.

A further object of the present invention is to provide a condensate collection pan having flow barriers such that the condensate must flow along a tortuous path before it reaches the condenser section of the unit.

Another object of the present invention is to provide an evaporator scroll and a partition such that a portion of the condensate flowing along the tortuous path may be heated by the ambient air circulated in heat exchange relationship with the condensate between the partition and the evaporator scroll.

A still further object of the present invention is to increase the temperature of the cold collected condensate from the evaporator of a room air conditioner prior to said condensate being conducted into the condenser section of the unit.

Another object of the present invention is to provide a method and apparatus for eliminating sweating from the exterior room air conditioner.

A still further object of the present invention is to provide a safe, reliable and economical method for achieving the herein described objects.

Other objects will be apparent from the description to follow and from the appended claims.

The above objects are accomplished according to a preferred embodiment of the invention of the provision of a condensate drain pan having various flow barriers such that the collected condensate from the evaporator must follow a tortuous path before it is conducted into the condenser section of the unit. Both depression barriers and embossments are utilized as flow barriers such that the condensate must circulate about these barriers. The evaporator fan scroll and the partition of the unit form an area in which the ambient air is allowed to circulate within the evaporator section of the unit thereby providing a source of heat from which the condensate may be warmed. The condensate is conducted from the condensate pan into the condenser section of the unit where it is subsequently discharged from the unit.

DESCRIPTION OF THE PREFERRED EMBODIMENT

The embodiment of the invention below is adapted for use in a room air conditioner for conducting condensate from the evaporator section to the condenser section. It is to be understood that the described apparatus and method for conducting condensate from one portion of an air conditioning unit to another finds like applicability in other types and sizes of air conditioning equipment as well as in similar articles wherein a cold fluid must be warmed to prevent sweating or other similar unwanted ramifications.

Figure 1:
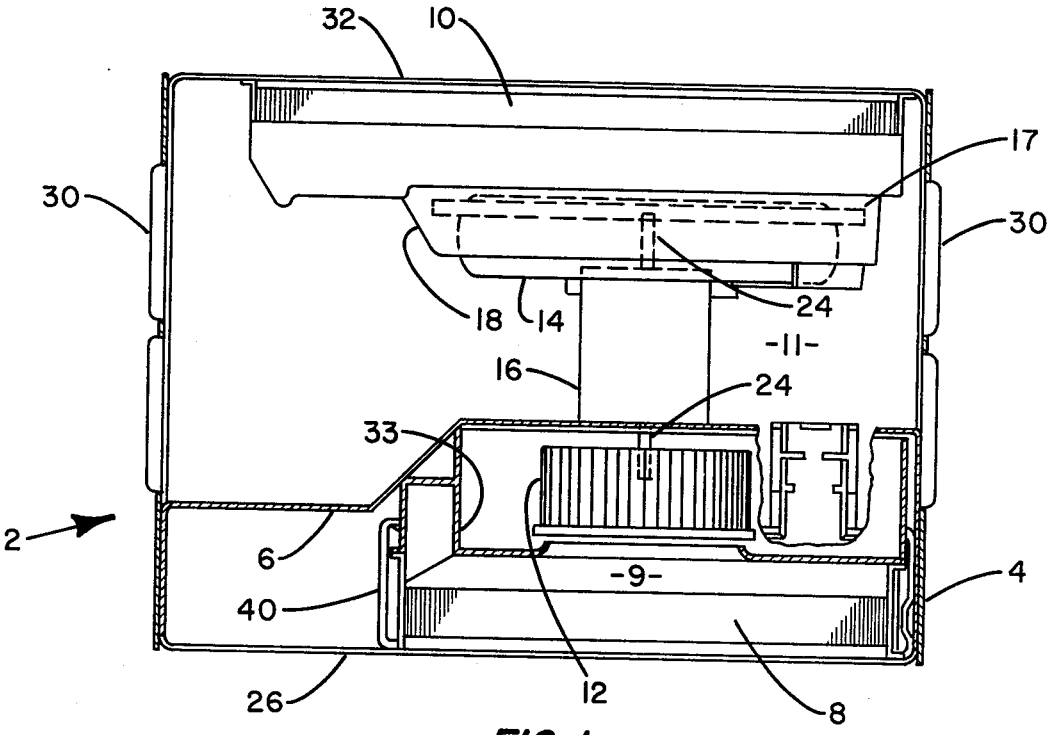
FIG. 1 is partially cutaway top view of a room air conditioner having a condensate pan, evaporator fan scroll and partition in accordance with the present invention.
Figure 2:
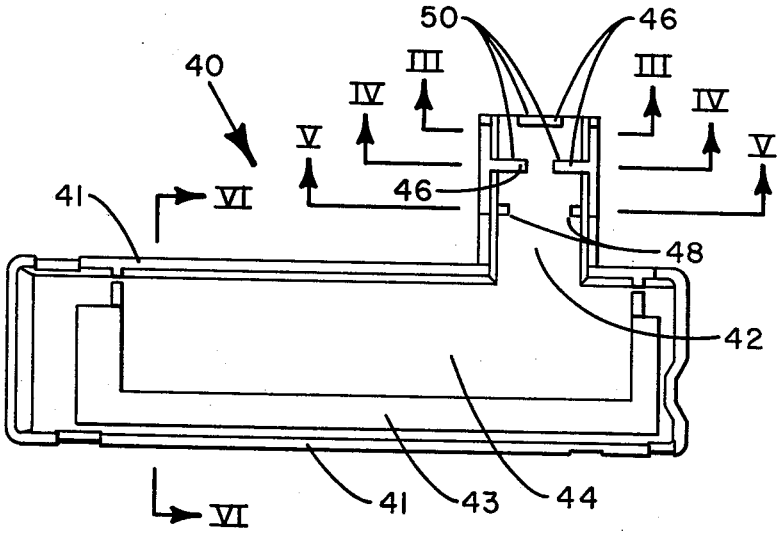
FIG. 2 is a top view of the condensate pan.

Referring now to the drawings there can be seen a typical room air conditioner denoted as 2 in FIG. 1. A partition 6 divides the unit into condenser section 11 and an evaporator section 9. Located within the condenser section 11 are fan motor 16, condenser fan 14 which is mounted on shaft 24 extending from motor 16, condenser fan shroud 18 encasing the condenser fan, and condenser 10. Air inlets 30 are provided in conjunction with air discharge outlet 32 such that the condenser fan may draw external air into the unit and discharge same through the condenser. Base pan 26 is formed in the shape of a walled water tight container such that it serves as the bottom of the unit and a structural member for the support of the other components.

Within evaporator section 9, evaporator 8 and evaporator fan 12 are mounted. Surrounding evaporator fan 12 is evaporator fan scroll 33 defining an air flow path such that air to be conditioned may be circulated through the evaporator 8. Evaporator fan 12 is a squirrel cage type fan mounted on shaft 24 of motor 16. Shown between evaporator 8 and base pan 26 is condensate pan 40. The condensate collected in evaporator 8 flows into condensate pan 40 and then flows along the pan through the various flow barriers into the condenser section 11. Within condenser section 11 this condensate is then remoed from the unit by use of slinger 17. The slinger acts to throw the water droplets into the condenser fan airstream such that this water is either discharged through the unit or vaporized on the condenser removing heat from the refrigerant. Typically the refrigerant is compressed in a compressor (not shown) thereafter condensed to a liquid in the condenser, conducted through expansion device (not shown) to the evaporator wherein it is flashed absorbing heat from the room air in communication therewith. In FIG. 1 portions of the evaporator scroll and partition are cutaway to show the location of the flow barriers within the condensate drain pan.

Referring more particularly to FIGS. 2 through 6 it can be seen that the condensate pan 40 has two portions, collection portion 44 where the condensate is collected as it drips from the evaporator and a trough portion 42 which conducts collected condensate to the condenser section. A raised evaporator pad 43 is provided such that the evaporator and the adjacent tube sheets are supported on a raised surface. Sidewalls 41 encase the entire condensate pan 40 such that the water collected is conducted thru the pan and does not spill over the sides. Within trough portion 42 are located various flow barriers 46. The flow barriers include depression barriers 48 which are formed below the surface of the trough portion of the condensate pan, and embossments 50 formed at the sides and the middle of the trough portion such that the flow must be around these embossments raised above the surface of the trough portion of the pan. These barriers can be more particularly seen in FIGS. 3 through 6 which are cross sections of various portions of condensate pan 40.

Figure 3:
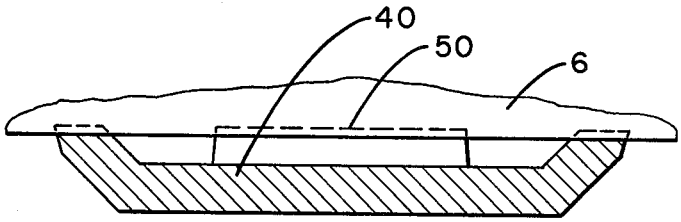
FIG. 3 is a sectional view of the condensate pan taken along line III—III in FIG. 2.
Figure 4:
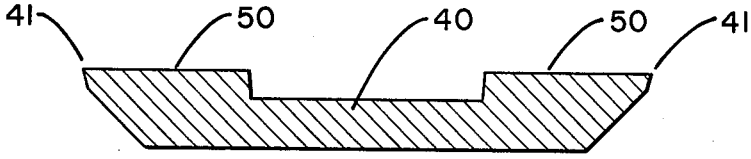
FIG. 4 is a sectional view of the condensate pan taken along line IV—IV in FIG. 2.
Figure 5:
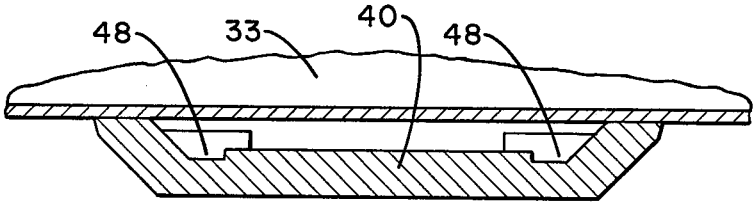
FIG. 5 is a sectional view of the condensate pan and evaporator scroll located thereon taken along line V—V in FIG. 2.
Figure 6:
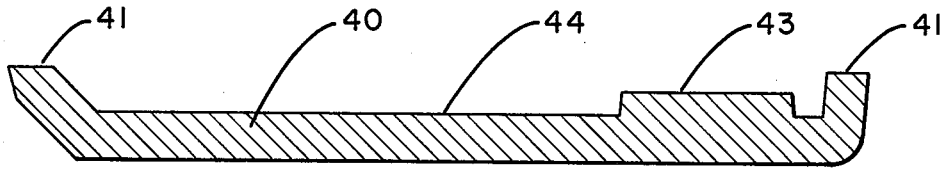
FIG. 6 is a sectional view of the condensate pan taken along line VI—VI in FIG. 2.

It can be seen in FIG. 3 that partition 6 is designed to rest on top of the condensate pan 40 at the end thereof such that a barrier is formed allowing small openings for the condensate as well as relatively warm ambient air to flow therethrough. Similarly as can be seen in FIG. 5 the evaporator scroll 33 forms a barrier with the depression barriers 48 such that the condensate must flow through the individual depressions. Warm ambient air is circulated between the evaporator scroll 33 and the partition 6 such that the condensate therebetween within the trough portion of the condensate pan is warmed by this air. Consequently when the condensate is emptied into the condenser section no sweating occurs on the exterior of the unit. FIGS. 4 and 6 are cross sections of the condensate pan taken at the locations shown on FIG. 2.

Typically the condensate pan may be made from an insulating substance such as plastic or styrofoam. The various flow barriers and embossments are merely indentations or raised surfaces formed within the single piece condensate pan. The location, number and size of the flow barriers is merely a design choice dependent upon the temperature increase desired, the possible contaminant problems and the necessary flow requirements.

The invention has been described in detail with particular reference to preferred embodiment thereof, but will be understood that variations and modifications can be affected within the spirit and scope of the invention.

We claim:

1. An air conditioning unit which comprises:

a base pan to which a partition is mounted such that the partition divides the air conditioning unit into an evaporator section and a condenser section; a condensate pan located in the evaporator section having a collection portion located below the evaporator to receive the condensate therefrom and a trough portion connecting the collection portion to the condenser section of the unit, said trough portion having at least one flow barrier forcing the condensate to follow a tortuous path such that the condensate is warmed sufficiently while travelling along the tortuous path that moisture is prevented from forming on the exterior of the unit, and means for allowing warm air from the condenser section to reject heat to the condensate in the trough portion of the condensate pan within the evaporator section of the unit.

2. The apparatus as set forth in claim 1 wherein the flow barriers of the trough portion of the condensate pan include at least one raised embossment in the condensate flow path.

3. The apparatus as set forth in claim 2 wherein the flow barriers of the condensate pan include at least one depression where the condensate may collect.

4. The apparatus as set forth in claim 3 further including:

an evaporator fan scroll which provides air guide surfaces for the evaporator and having a meeting surface which mates with the trough portion of the condensate pan at the depression formed therein to conduct the condensate to the depression for the condensate to flow through the evaporator scroll towards the condenser section.

5. The apparatus as set forth in claim 4 wherein the ambient air of the condenser section is in communication with the condensate in the condensate pan trough portion between the evaporator scroll and the partition to effect a raise in temperature of the condensate flowing therethrough.

6. In an air conditioning unit having a base pan, a partition dividing the unit into an evaporator section and a condenser section, an evaporator within the evaporator section wherein condensate is formed and means for riding the unit of said condensate within the condenser section, the improvement comprising:

a condensate pan having a collection portion located below the evaporator to receive the condensate therefrom and a trough portion connecting the collection portion to the condenser section of the unit, said trough portion having at least one flow barrier forcing the condensate to follow a tortuous path such that the condensate is warmed sufficiently while traveling along the tortuous path that moisture is prevented from forming on the exterior of the unit.

7. The apparatus as set forth in claim 6 wherein the trough portion of the condensate pan has both embossments and depressions to guide the condensate through the tortuous flow path.

8. A method of reducing moisture formed on the exterior surface of an air conditioning unit as a result of cold condensate being in contact with the interior surface of the unit, said unit having a partition which divides the unit into an evaporator section having an evaporator where condensate is formed and a condenser section having means for ridding the unit of condensate which comprises the steps of:

collecting at least a portion of the condensate formed in the evaporator in a condensate pan;

conducting the condensate from the condensate pan to the condenser section through a tortuous flow path such that the temperature of the condensate is increased during flow along the path; providing for heat exchange communication between outdoor air and the condensate while the condensate is flowing along the tortuous flow path; and ridding the unit of condensate within the condenser section.

9. The method as set forth in claim 8 wherein the step of conducting includes:

controlling the flow of condensate to alternatingly broaden and constrict the flow stream.

* * * * *